US006456001B1

(12) United States Patent
Iida et al.

(10) Patent No.: US 6,456,001 B1
(45) Date of Patent: Sep. 24, 2002

(54) FLUORESCENT LAMP HAVING V-SHAPED GROOVES FOR GUIDING LEAD WIRE

(75) Inventors: Shiro Iida; Takeshi Matsumura; Kenji Itaya, all of Osaka; Tetsuya Tahara, Shiga, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/498,226

(22) Filed: Feb. 3, 2000

(30) Foreign Application Priority Data

Feb. 8, 1999 (JP) ..... 11-029565

(51) Int. Cl.[7] ..... H01J 1/62; H01J 63/04; H01J 5/48; H01J 5/50; H01K 1/00

(52) U.S. Cl. ..... 313/493; 313/318.01; 313/318.06; 313/318.09; 313/318.1; 439/615

(58) Field of Search ..... 313/493, 634, 313/318.01, 318.03, 318.04, 318.06, 318.09, 318.1, 318.12, 324; 439/611, 612, 613, 614, 615; 174/DIG. 2

(56) References Cited

FOREIGN PATENT DOCUMENTS

| | | |
|---|---|---|
| DE | 75 16 486 | 11/1976 |
| DE | 2 042 823 | 9/1980 |
| DE | 216 575 | 12/1984 |
| DE | 296 22 029 | 4/1998 |
| JP | 8-167766 | 6/1996 |
| JP | 10-275592 | 10/1998 |

*Primary Examiner*—Vip Patel
*Assistant Examiner*—Mack Haynes
(74) *Attorney, Agent, or Firm*—Merchant & Gould PC

(57) ABSTRACT

A fluorescent lamp in which a connecting terminals of a lighting circuit board and lead wires of a fluorescent tube easily can be connected. The lamp includes a fluorescent tube, a holder holding the fluorescent tube, a lighting circuit board provided with a lighting circuit for lighting the fluorescent tube, and a case connected to the holder and housing the lighting circuit board. At the end portion of the lighting circuit board, V-shaped or Y-shaped cut-outs, which widen toward an outer side, are formed. In the vicinity of the inner narrow portion of the cut-outs, the connecting terminals connected to the lighting circuit are provided. On a side wall formed on the holder opposite to the fluorescent tube, V-shaped or Y-shaped cut-outs, which widen as the distance from said fluorescent tube increases, are provided, and the broad portion of the cut-outs of the holder and the broad portion of the cut-outs of the lighting circuit board are arranged facing each other. The lead wires of the fluorescent tube are connected to the connection terminals by welding.

3 Claims, 4 Drawing Sheets

FLUORESCENT LAMP HAVING V-SHAPED GROOVES FOR GUIDING LEAD WIRE

FIELD OF THE INVENTION

The present invention relates to a fluorescent lamp having a fluorescent tube and a lighting circuit board therefor.

BACKGROUND OF THE INVENTION

In a conventional fluorescent lamp, for example, a bulb-shaped fluorescent lamp, examples of a method for connecting a lead wire of a fluorescent tube to a lighting circuit board include, for example, a lapping connection. In the lapping connection, as described in Publication of Japanese Patent Application No. Hei 10-275592 A, lapping pins 28, each having a square cross section, are provided on a lighting circuit board as connecting terminals and then lead wires 35 of a fluorescent tube are wound around the lapping pins 28 several times, thereby connecting the lead wires of the fluorescent tube and the lighting circuit board. In another conventional connecting method, Y-shaped connecting terminals are provided on a lighting circuit board and lead wires are inserted into the Y-shaped connecting terminals, thereby connecting the lead wires to the connecting terminals by caulking.

However, in such conventional bulb-formed fluorescent lamps, when the lead wires of the fluorescent tube are connected to the lighting circuit, the directions in which the lead wires extend are not the same. Therefore, it was extremely difficult to automate the connection by using a machine. Even when the connection is automated, faults are frequently found in that the lead wires cannot properly be connected to the terminals of the lighting circuit.

Furthermore, the lapping connection takes a long time since each lead wire is wound around each square pin five or six times. Therefore, the assembly operation efficiency is significantly impaired. On the other hand, the caulking connection by using the Y-shaped connecting terminals results in poor contacting due to vibration during transportation of the product even if the caulking is only slightly weak. Therefore, the reliability is not sufficient. Another problem is that the connecting terminal itself is expensive.

SUMMARY OF THE INVENTION

It is an object of the present invention to solve the problems of the prior art. That is, the object of the present invention is to provide a fluorescent lamp in which connecting terminals of a lighting circuit board and lead wires of a fluorescent tube easily can be connected and which is excellent in assembly operation efficiency, cheap and capable of achieving a highly reliable connection.

In order to achieve the above-mentioned object, a fluorescent lamp of the present invention includes a fluorescent tube, a holder holding the fluorescent tube, a lighting circuit board provided with a lighting circuit for lighting the fluorescent tube, and a case connected to the holder and housing the lighting circuit board. At the end portion of the lighting circuit board, cut-outs are formed, which widen toward an outer side of the lighting circuit board. In the vicinity of the inner narrow portion of each cut-out, the connecting terminal connected to the lighting circuit is provided. Each lead wire of the fluorescent tube is connected to the connecting terminal.

According to this configuration, since the lead wires of the fluorescent tube easily can be led to the connecting terminals of the lighting circuit board, it is possible to automate the connection between the lead wires and the connecting terminals. Thus, assembly operation efficiency and productivity can be improved.

In the above-mentioned configuration, the cut-out is V-shaped or Y-shaped. Thus, the lead wires of the fluorescent tube are easily led to the connecting terminals provided on the lighting circuit board, so that the position of the lead wire can easily be matched with the position of the connecting terminal.

Furthermore, in the above-mentioned configuration, cut-outs, which widen as the distance from the fluorescent tube increases and which are V-shaped or Y-shaped, are provided on a side wall placed on the holder opposite to the fluorescent tube and that the broad portion of the cut-outs of the holder and the broad portion of the cut-outs of the lighting circuit board are arranged facing each other.

According to this configuration, when the fluorescent tube is attached to the holder, the wires can be held by the side wall after they are bent toward the outer side of the holder. Therefore, after the fluorescent tube is attached to the holder, when the lighting circuit board is attached to the holder, the lead wires of the fluorescent tube are not obstructing to the attachment of the lighting circuit board. Furthermore, since the broad portion of the cut-outs of the lighting circuit board and the broad portions of the cut-outs of the side wall placed on the holder are facing each other, by bending the lead wires, which were bent toward the outer side of the holder, toward the side of the lighting circuit board, the lead wires easily can be led to the connecting terminals of the lighting circuit board. Consequently, the position of the lead wires easily can be matched with the position of the connecting terminals.

Furthermore, in the above-mentioned configuration, the lead wires of the fluorescent tube are connected to the connecting terminals of the lighting circuit board by welding. Thus, a strong connection between the lead wires of the fluorescent tube and the connecting terminals of the lighting circuit board can be realized, the reliability of the connecting portion is improved and the connection excellent in assembly operation efficiency can be realized.

Furthermore, the connecting terminal of the lighting circuit board may be a jumper lead wire. Thus, the position of the lead wires of the fluorescent tube can be matched with the position of the connecting terminals of the lighting circuit board more easily, and mass production can be realized o more easily and further cheaply.

DESCRIPTION OF THE PREFERRED EMBODIMENTS

Hereinafter, the present invention will be described by way of embodiments with reference to drawings.

Figure 1:
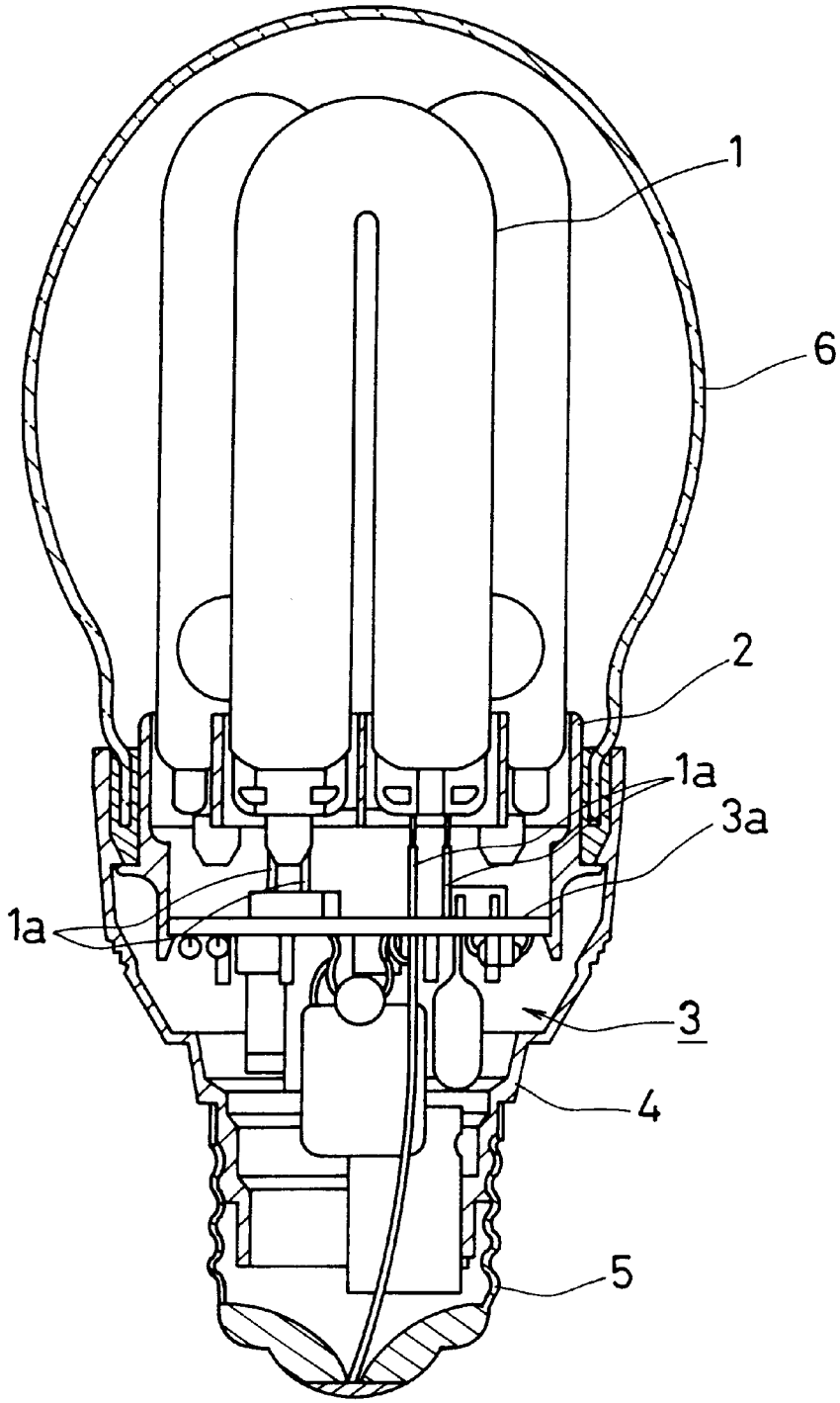
FIG. 1 is a partial cutaway front view showing a bulb-shaped fluorescent lamp in one embodiment according to the present invention.

As shown in FIG. 1, a bulb-shaped fluorescent lamp of the present invention includes a fluorescent tube 1, a lighting circuit board 3*a,* a holder 2, a case 4 and a base 5. The fluorescent tube 1 is covered with a globe 6. In this structure of the fluorescent tube 1, three U-shaped tubes are joined into one body to form a discharge path therein. On the lighting circuit board 3*a,* a lighting circuit 3 for lighting the fluorescent tube 1 is mounted. The fluorescent tube 1 and the lighting circuit board 3*a* are held by the holder 2. The case 4 surrounds the lighting circuit board 3*a* and is attached to the holder 2. The base 5 is provided on one end of the case 4 opposite to the holder 2.

Filament coils (not shown) are provided on both ends of the inner side of the fluorescent tube 1. The lead wires 1*a,* which supply electric current to the filament coils, are led out of the both ends of the fluorescent tube 1.

Figure 2:
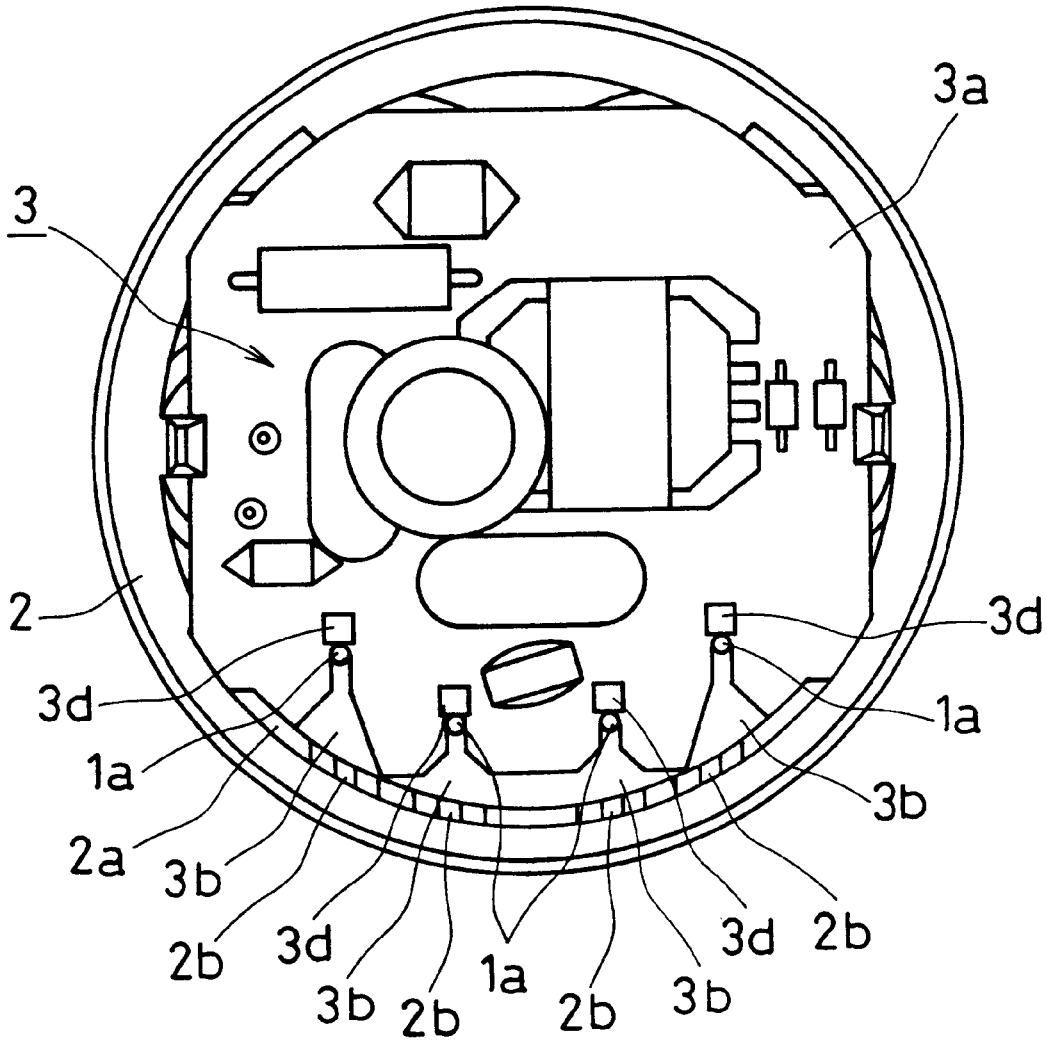
FIG. 2 is a bottom view showing the fluorescent lamp of FIG. 1 according to the present invention shown by partially taken away.
Figure 3:
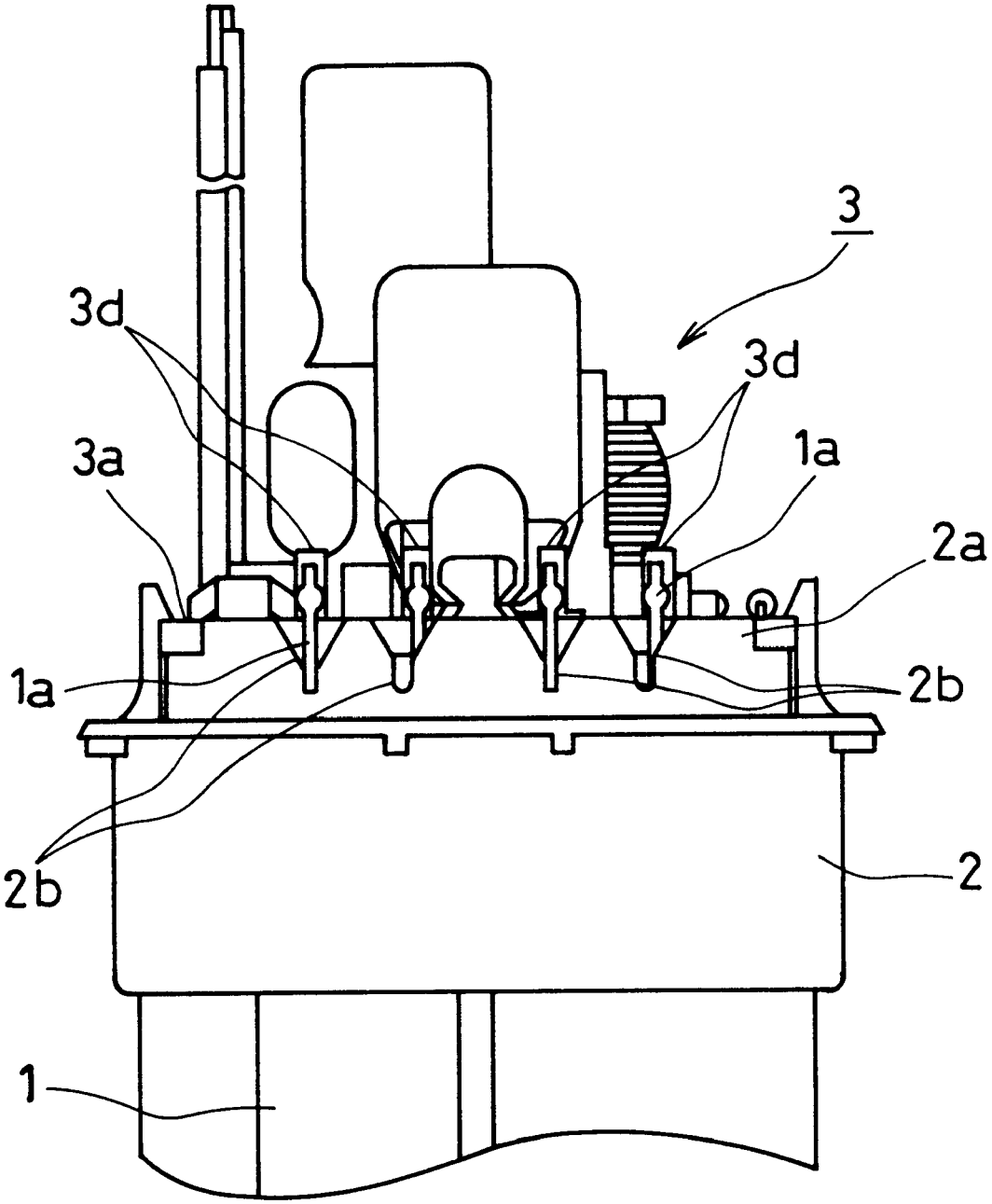
FIG. 3 is a front view showing a part of the fluorescent lamp of FIG. 2.

FIG. 2 is a bottom view of the fluorescent lamp of FIG. 1, while taking away the case 4 and the base 5 and shows a structure of the part in which the lighting circuit board 3*a* is connected to the lead wire 1*a* of the fluorescent tube 1. FIG. 3 is a front view showing the structure of a part of the fluorescent lamp of FIG. 2. The lamp of FIG. 3 is shown so that the orientation is upside down with respect to that of FIG. 1.

As shown in FIG. 2, Y-shaped cut-outs 3*b,* which widen toward the outer side of the lighting circuit board 3*a,* are formed on the portion in which the lead wires 1*a* of the fluorescent tube 1 are connected to the lighting circuit board 3*a*. In the vicinity of the inner narrow portion of each Y-shaped cut-out 3*b,* namely, the vertex of each cut-out 3*b,* a square pin 3*d* connected to each lead wire 1*a* of the fluorescent tube 1 is provided. The square pin 3*d* is a connecting terminal of the lighting circuit board 3*a*.

With this configuration, when the lead wires 1*a* and the square pins 3*d* are connected, the lead wires 1*a* easily can be led to the square pins 3*d* being guided by the Y-shaped cut-outs 3*b,* thus enabling the precise positioning. Moreover, it is possible easily to connect the lead wires 1*a* and the square pins 3*d* by, for example, laser welding, or resistance welding, etc.

The cut-outs 3*b* may be V-shaped instead of being Y-shaped. Also, connecting terminals that are Y-shaped, etc., instead of the square pins 3*d*, may be used.

In this embodiment, on the side wall 2*a* formed on the holder opposite to the fluorescent tube 1, V-shaped or Y-shaped cut-outs 2*b*, which widen as the distance from the fluorescent tube 1 increases, are provided.

When assembling, when the fluorescent tube 1 is attached to the holder 2, lead wires 1*a* are inserted into the cut-outs 2*b* and the lead wires are bent toward the outside of the holder 2 in advance. Thereafter, the lighting circuit board 3*a* is attached to the holder 2 so that the broad portion of the cut-outs 2*b* and the broad portion of the cut-outs 3*b* of the lighting circuit board 3*a* are facing each other at about 90°. Thereafter, the lead wires 1*a* that were bent toward the outside of the holder 2 are inserted into the cut-outs 3*b* of the lighting circuit board 3*a*. Thus, the lead wires 1*a* easily can be positioned before the lighting circuit board 3*a* is held by the holder 2. In addition, when the lighting circuit board 3*a* is attached to the holder 2, the lead wires 1*a* can be prevented from obstructing the attachment. Consequently, the lighting circuit board 3*a* can be attached smoothly to the holder 2. Furthermore, each lead wire 1*a* can easily be led to each square pin 3*d* that is a connecting terminal. The precise positioning easily can be performed and a welding connection between the lead wires 1*a* and the square pins 3*d* can be facilitated.

As mentioned above, since the precise positioning of the lead wires 1*a* of the fluorescent tube 1 can be realized, the lead wires 1*a* of the fluorescent tube 1 easily can be connected to the square pins 3*d* or the Y-shaped connecting terminals by direct laser welding, resistance welding, or the like. Therefore, unlike the conventional lapping connection, the operation does not require a long time, and a connection that is highly reliable and is suitable for mass production can be realized.

Figure 4:
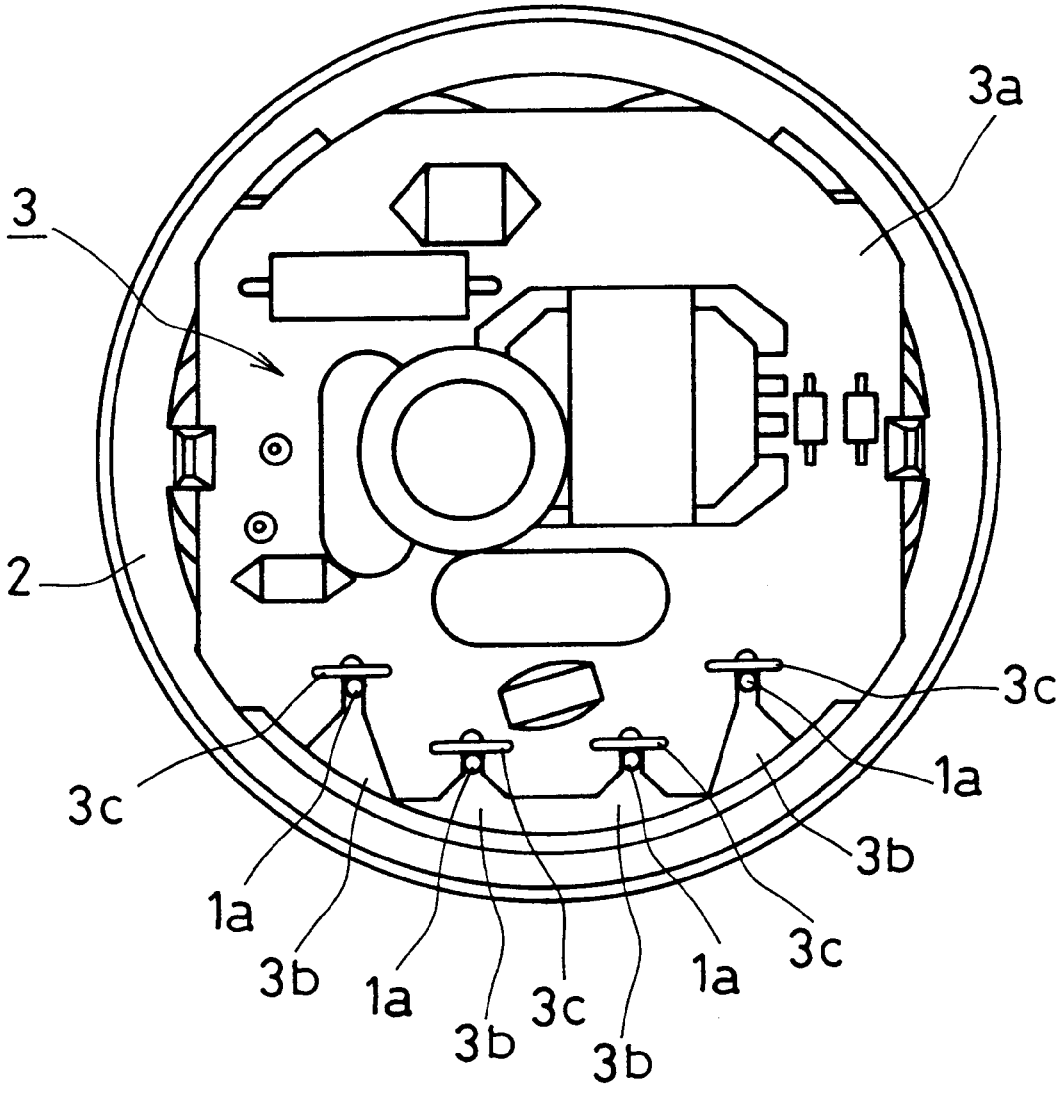
FIG. 4 is a bottom view showing a fluorescent lamp in another embodiment according to the present invention shown similar to that of FIG. 2.

As shown in FIG. 4, as the connecting terminals of the lighting circuit board 3*a,* jumper lead wires 3*c* may be provided spanning each cut-out 3*b*. If the jumper lead wires 3*c* and the lead wires 1*a* of the fluorescent tube 1 are connected by laser welding or resistance welding, the connection which is further reduced in cost and is suitable for mass production can be realized.

In the above-mentioned embodiments, the lamp having the fluorescent tube 1 in which three U-shaped tubes are joined into one body to form a discharge path inside is explained. However, the present invention is not limited to this alone, and any shapes of the fluorescent tube, for example, four or five U-shaped tubes are bridge-connected, etc. may be employed.

The invention may be embodied in other specific forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A fluorescent lamp comprising a fluorescent tube having lead wires led from both ends of the tube, the tube having a structure in which both ends of the tube are positioned adjacent each other, a holder holding said fluorescent tube, a lighting circuit board provided with a lighting circuit for lighting said fluorescent tube, connecting terminals connected to said lighting circuit, the connecting terminals being disposed at a peripheral area of one side of said lighting circuit board and arranged adjacently to each other along an arc line, and a case connected to said holder and housing said lighting circuit board;

wherein first V-shaped or Y-shaped cut-outs, which widen toward an outer side of the lighting circuit board, are formed at the end portion of said lighting circuit board so as to be provided for the respective connecting terminals, the connecting terminals being positioned in the vicinity of the inner narrow portions of said cut-outs, second V-shaped or Y-shaped cut-outs, which widen as the distance from said fluorescent tube increases, are provided on a side wall formed on said holder opposite to said fluorescent tube, the broad portion of the cut-outs of said holder and the broad portion of the cut-outs of said lighting circuit board being arranged facing each other; and the lead wires of said fluorescent tube are connected to said connecting terminals by welding.

2. The fluorescent lamp according to claim 1, wherein the connecting terminals comprise a jumper lead wire.

3. The fluorescent lamp according to claim 1, wherein the first cut-outs positioned in the vicinity of the outermost connecting terminals are deeper than the first cut-outs positioned in the vicinity of the connecting terminals between the outermost connecting terminals.

* * * * *